US010272475B2

(12) United States Patent
Scipio et al.

(10) Patent No.: US 10,272,475 B2
(45) Date of Patent: Apr. 30, 2019

(54) OFFLINE COMPRESSOR WASH SYSTEMS AND METHODS

(71) Applicant: General Electric Company, Schenectady, NY (US)

(72) Inventors: Alston Ilford Scipio, Mableton, GA (US); Sanji Ekanayake, Mableton, GA (US)

(73) Assignee: General, Electric Company, Schenectady, NY (US)

( * ) Notice: Subject to any disclaimer, the term of this patent is extended or adjusted under 35 U.S.C. 154(b) by 233 days.

(21) Appl. No.: 13/670,511

(22) Filed: Nov. 7, 2012

(65) Prior Publication Data

US 2014/0124007 A1 May 8, 2014

(51) Int. Cl.

| | |
|---|---|
| ***B08B 3/04*** | (2006.01) |
| ***F01D 25/00*** | (2006.01) |
| ***B08B 3/02*** | (2006.01) |
| ***B01F 5/04*** | (2006.01) |
| ***B01F 3/08*** | (2006.01) |
| ***B05B 12/14*** | (2006.01) |
| ***B05B 7/32*** | (2006.01) |
| *B01F 5/00* | (2006.01) |

(52) U.S. Cl.

CPC ..... *B08B 3/02* (2013.01); *B01F 3/0865* (2013.01); *B01F 5/0475* (2013.01); *B05B 7/32* (2013.01); *B05B 12/1418* (2013.01); *B01F 2003/0896* (2013.01); *B01F 2005/0034* (2013.01)

(58) Field of Classification Search

CPC .... B08B 3/00; B08B 3/02; B08B 9/00; B08B 9/02; B08B 3/04; F01D 25/002; F01D 25/007

See application file for complete search history.

(56) References Cited

U.S. PATENT DOCUMENTS

| | | | | |
|---|---|---|---|---|
| 4,647,212 | A * | 3/1987 | Hankison | 366/165.5 |
| 4,808,235 | A * | 2/1989 | Woodson et al. | 134/22.19 |
| 4,886,369 | A * | 12/1989 | Hankison | 366/165.5 |
| 5,131,757 | A * | 7/1992 | Smith | 366/165.5 |
| 5,716,458 | A * | 2/1998 | Machino | B08B 3/08 134/1 |
| 6,050,079 | A | 4/2000 | Durgin et al. | |

(Continued)

FOREIGN PATENT DOCUMENTS

| | | | | |
|---|---|---|---|---|
| EP | 0674024 B1 | 12/1998 | | |
| EP | 1557539 A1 * | 7/2005 | | F01D 25/00 |

(Continued)

OTHER PUBLICATIONS

EP1557539A1—Machine Translation, Jul. 2005.*

(Continued)

*Primary Examiner* — Marc Lorenzi

(74) *Attorney, Agent, or Firm* — Eversheds Sutherland (US) LLP

(57) ABSTRACT

The present application thus provides a wash system for use with a compressor having a bellmouth and one or more extraction pipes. The wash system may include a water source, a first fluid source, a mixing chamber in communication with the water source and the first fluid source, a bellmouth line in communication with the mixing chamber and the bellmouth, and a stage line in communication with one of the extraction pipes.

8 Claims, 2 Drawing Sheets

(56) References Cited

U.S. PATENT DOCUMENTS

| | | | | |
|---|---|---|---|---|
| 6,116,016 | A * | 9/2000 | Wada | C10L 1/12 60/39.17 |
| 6,364,602 | B1 * | 4/2002 | Andrew | F01D 21/10 415/1 |
| 6,385,958 | B2 | 5/2002 | Leone et al. | |
| 6,393,825 | B1 | 5/2002 | Leone et al. | |
| 6,478,033 | B1 | 11/2002 | Foster | |
| 6,491,048 | B1 * | 12/2002 | Foster | F01D 25/002 134/166 R |
| 6,615,574 | B1 | 9/2003 | Marks | |
| 6,630,198 | B2 | 10/2003 | Ackerman et al. | |
| 6,644,935 | B2 | 11/2003 | Ingistov et al. | |
| 6,657,715 | B2 | 12/2003 | Vaez-Iravani et al. | |
| 6,659,715 | B2 | 12/2003 | Kuesters et al. | |
| 6,786,635 | B2 | 9/2004 | Choi | |
| 6,796,709 | B2 | 9/2004 | Choi | |
| 7,243,042 | B2 | 7/2007 | Plotts et al. | |
| 7,548,839 | B2 | 6/2009 | Goebel et al. | |
| 8,096,747 | B2 | 1/2012 | Sengar et al. | |
| 8,197,613 | B2 | 6/2012 | Kerber | |
| 8,268,134 | B2 | 9/2012 | Goller et al. | |
| 2002/0141882 | A1 | 10/2002 | Ingistov et al. | |
| 2004/0026261 | A1 | 2/2004 | Stoffer et al. | |
| 2004/0073400 | A1 | 4/2004 | Tomita et al. | |
| 2007/0048127 | A1 | 3/2007 | O'Neill et al. | |
| 2007/0137213 | A1 | 6/2007 | Rickert et al. | |
| 2008/0173330 | A1 * | 7/2008 | Wagner | 134/18 |
| 2008/0236150 | A1 * | 10/2008 | Jarvi | F01D 25/002 60/320 |
| 2009/0053036 | A1 * | 2/2009 | Crawley | F02C 7/042 415/58.4 |
| 2009/0158739 | A1 | 6/2009 | Messmer | |
| 2010/0080685 | A1 | 4/2010 | Morgan et al. | |
| 2010/0102835 | A1 * | 4/2010 | Chillar | F01D 25/007 324/700 |
| 2011/0259375 | A1 * | 10/2011 | Gebhardt et al. | 134/34 |
| 2012/0083933 | A1 | 4/2012 | Subbu et al. | |
| 2012/0134777 | A1 | 5/2012 | Eleftheriou et al. | |
| 2012/0145187 | A1 | 6/2012 | Abe et al. | |
| 2012/0167547 | A1 * | 7/2012 | Zhang | F01D 25/002 60/39.183 |
| 2012/0251742 | A1 | 10/2012 | Kerber | |

FOREIGN PATENT DOCUMENTS

| | | | |
|---|---|---|---|
| EP | 1903188 | A2 | 3/2008 |
| GB | 796269 | A | 6/1958 |
| JP | 2008291829 | A * | 12/2008 |

OTHER PUBLICATIONS

JP2008291829—Machine Translation (Year: 2008).*
U.S. Appl. No. 13/303,852, filed Nov. 23, 2011, Scipio, et al.
U.S. Appl. No. 13/485,160, filed May 31, 2012, Ekanayake, et al.
U.S. Appl. No. 13/485,273, filed May 31, 2012, Ekanayke, et al.
U.S. Appl. No. 13/347,358, filed Jan. 10, 2012, Chillar, et al.
U.S. Appl. No. 13/492,333, filed Jun. 8, 2012, Scipio.
Unofficial English Translation of Chinese Office Action issued in connection with Related CN Application No. 201410739265.3 dated Mar. 28, 2017.
U.S. Non Final Office Action issued in connection with Related U.S. Appl. No. 14/099,299 dated Sep. 8, 2016.
U.S. Final Office Action issued in connection with Related U.S. Appl. No. 14/099,299 dated Apr. 4, 2017.

* cited by examiner

OFFLINE COMPRESSOR WASH SYSTEMS AND METHODS

TECHNICAL FIELD

The present application and the resultant patent relate generally to gas turbine engines and more particularly relate to offline compressor wash systems and methods for effective washing and application of anti-static solution, particularly to later compressor stages.

BACKGROUND OF THE INVENTION

As a gas turbine engine operates, airborne contaminants may coat the blades and the vanes of the compressor and other components. Specifically, the blades and the vanes may develop a static charge that attracts electrostatically charged particles. Over time, particulate accumulation may restrict the airflow through the compressor and may adversely impact on overall gas turbine engine performance and efficiency. In order to reduce such accumulation, water spray systems may be used to remove the accumulated particulate matter from the compressor blades and vanes. The water wash systems may use a cleaning solution of water and a detergent followed by a rinse and possibly by the application of an anti-static solution to impede a further buildup of the particulate matter.

Although such water wash systems may be effective in cleaning early compressor stages, the middle and later compressor stages often show reduced cleaning or relatively little cleaning at all because the cleaning solution is generally injected about a bellmouth at the front end of the compressor. Moreover, residual amounts of the cleaning solution may remain in the compressor and may have an impact on subsequent restart procedures.

There is thus a desire for improved offline compressor water wash systems and methods. Preferably, such improved systems and methods may adequately wash and apply anti-static solution to all compressor stages, particularly to later compressor stages, for improved performance and efficiency while also providing for adequate draining therein.

SUMMARY OF THE INVENTION

The present application and the resultant patent thus provide a wash system for use with a compressor having a bellmouth and one or more extraction pipes. The wash system may include a water source, a first fluid source, a mixing chamber in communication with the water source and the first fluid source, a bellmouth line in communication with the mixing chamber and the bellmouth, and a stage line in communication with one of the extraction pipes.

The present application and the resultant patent further provide a method of providing a fluid to a compressor with a number of stages. The method may include the steps of mixing water and a first fluid into a mixed water/first fluid solution, flowing a first portion of the mixed water/first fluid solution to a bellmouth of the compressor, and flowing a second portion of the mixed water/first fluid solution to an X-stage extraction pipe.

The present application and the resultant patent further provide a wash system for use with a compressor having a bellmouth and a number extraction pipes. The wash system may include a water source, a detergent source, an anti-static solution source, a mixing chamber in communication with the water source, the detergent source, and the anti-static solution source, a bellmouth line in communication with the mixing chamber and the bellmouth, and a number of stage lines in communication with the number of the extraction pipes.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
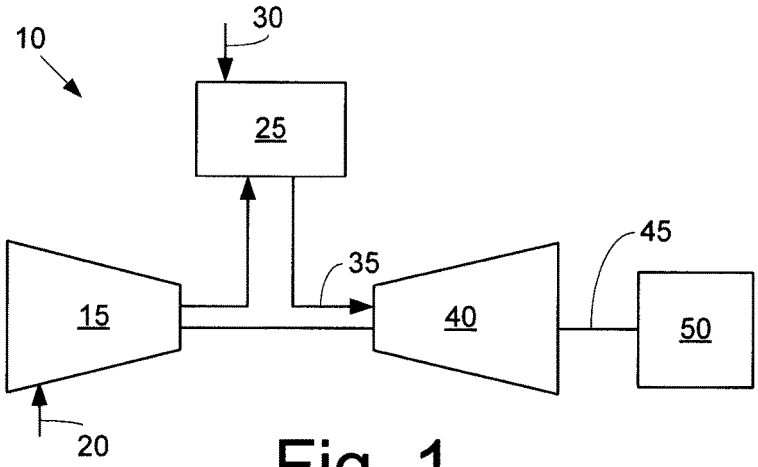
FIG. 1 is a schematic diagram of a gas turbine engine showing a compressor, a combustor, a turbine, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
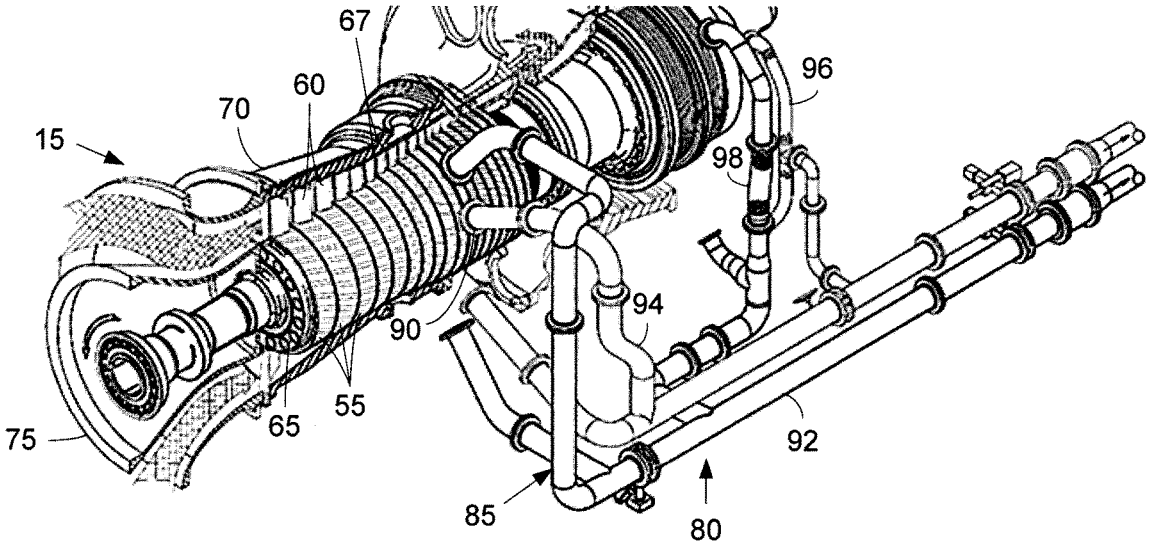
FIG. 2 is a partial sectional view of a compressor with compressor extraction piping.

FIG. 2 is an example of a compressor 15 as may be used with the gas turbine engine 10 and the like. The compressor 15 may include a number of stages 55. Although eighteen stages 55 are shown, any number of the stages 55 may be used. Each stage 55 includes a number of circumferentially arranged rotating blades 60. Any number of the blades 60 may be used. The blades 60 may be mounted onto a rotor wheel 65. The rotor wheel 65 may be attached to the shaft 45 for rotation therewith. Each stage 55 also may include a number of circumferentially arranged stationary vanes 67. Any number of the vanes 67 may be used. The vanes 67 may be mounted within an outer casing 70. The casing 70 may extend from a bellmouth 75 towards the turbine 40. The flow of air 20 thus enters the compressor 15 about the bellmouth 75 and is compressed through the blades 60 and the vanes 67 of the stages 55 before flowing to the combustor 25.

The gas turbine engine 10 also may include an air extraction system 80. The air extraction system 80 may extract a portion of the flow of air 20 in the compressor 15 for use in cooling the turbine 40 and for other purposes. The air extraction system 80 may include a number of air extraction pipes 85. The air extraction pipes 85 may extend from an extraction port 90 about one of the compressor stages 55 towards one of the stages of the turbine 40. In this example, an X-stage extraction pipe 92 and a Y-stage extraction pipe 94 may be shown. The X-stage extraction pipe 92 may be positioned about a ninth stage and the Y-stage extraction pipe 94 may be positioned about the thirteenth stage. Extractions from other stages 55 of the compressor 15, however, also may be used. The X-stage extraction pipe 92 may be in communication with an X-stage 96 of the turbine 40 while the Y-stage extraction pipe 94 may be in communication with a Y-stage 98 of the turbine 40. The X-stage 96 may be a third stage and the Y-stage 98 may be a second stage although other turbine stages also may be used herein. (The terms "X-stage", "Y-stage", and the like are used herein as opposed to "first stage", "second stage", and the like so as to prevent an inference that the systems and methods described herein are in any way limited to use with the actual first stage or the second stage of the compressor or the turbine.)

Figure 3:
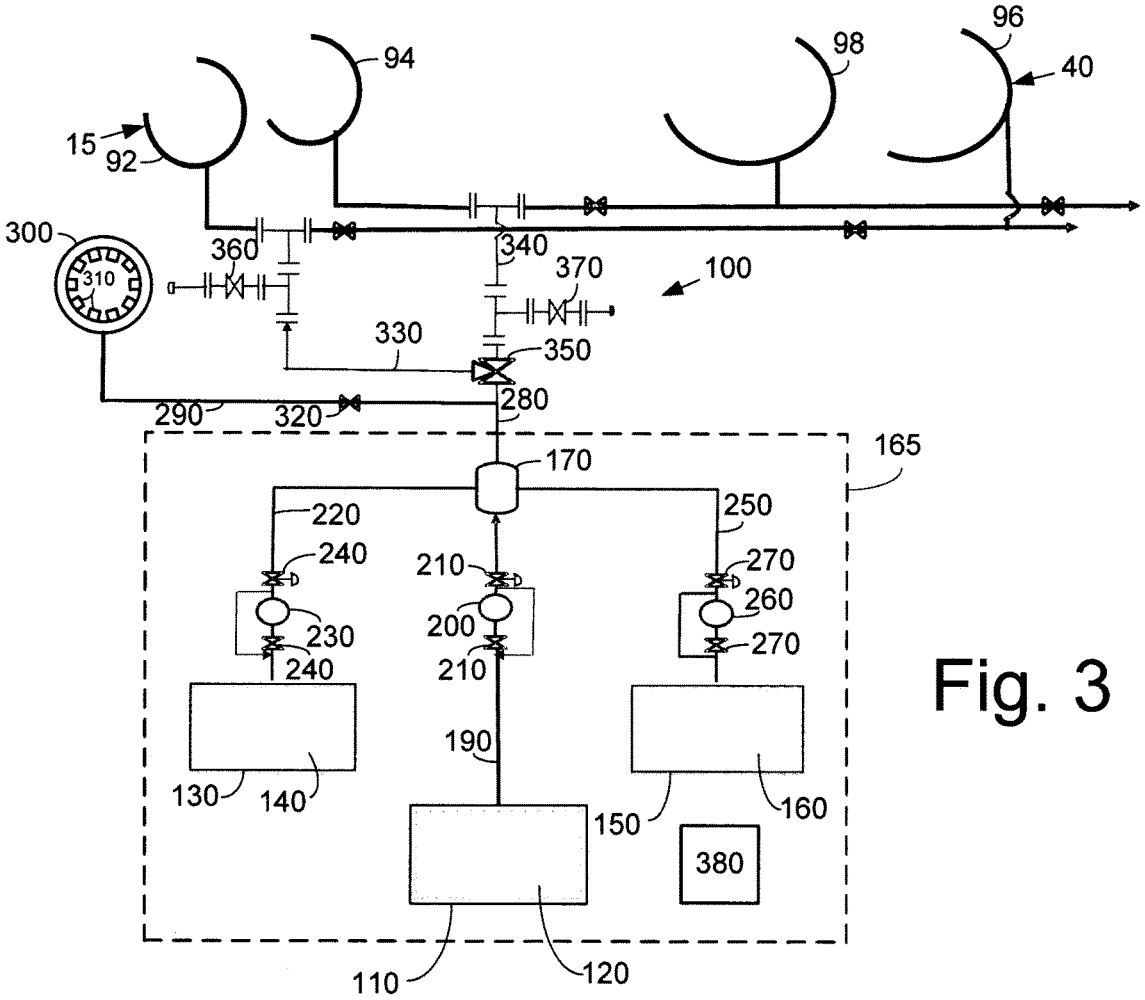
FIG. 3 is a schematic diagram of a compressor wash system as may be described herein.

FIG. 3 shows a compressor wash system 100 as may be described herein. The compressor wash system 100 may include a water source 110. The water source 110 may have any size, shape, or configuration. The water source 110 may have a volume of water 120 therein. The compressor wash system 100 also may include a detergent source 130. The detergent source 130 may have any size, shape, or configuration. The detergent source 130 may have a volume of a detergent 140 therein. The detergent 140 may be any type of cleaning solution. The detergent 140 may be diluted with the water 120 in a predetermined ratio. The compressor wash system 100 also may include an anti-static solution source 150. The anti-static solution source 150 may have any size, shape, or configuration. The anti-static solution source 150 may have a volume of an anti-static solution 160 therein. The anti-static solution 160 may be any type of anti-static fluid. The anti-static solution 160 may be diluted with the water 120 in a predetermined ratio. The water source 110, the detergent source 130, and the anti-static solution source 150 may be positioned on a wash skid 165 in whole or in part. The wash skid 165 may be mobile and may have any size, shape, or configuration. Other components and other configurations may be used herein.

Figure 4:
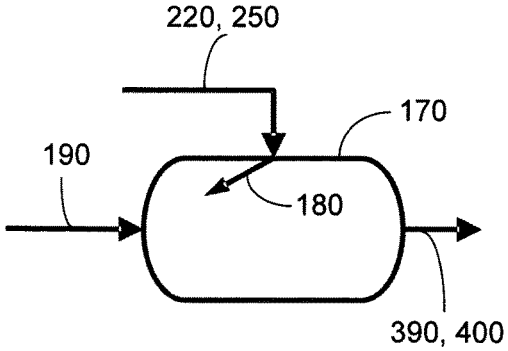
FIG. 4 is a schematic diagram of a mixing chamber as may be used with the compressor wash system of FIG. 3.

The compressor wash system 100 also may include a mixing chamber 170. The mixing chamber 170 may be used to mix the detergent 140 and the water 120 or the anti-static solution 160 and the water 120. Other combinations may be used herein. Non-diluted fluids also may be used herein. FIG. 4 shows an example of the mixing chamber 170. The mixing chamber 170 may include a number of angled counter flow nozzles 180 for the flow of the detergent 140 and/or the anti-static solution 160 or other type of secondary flows. The flow of detergent 140 or the anti-static solution 160 may be injected at an angle via the angled counter flow nozzles 180 into the incoming flow of water 120 or other type of primary flow for good mixing therein without the use of moving parts. Good mixing also may be provided by also injecting the flow of detergent 140 or the anti-static solution 160 at a higher pressure as compared to the flow of water 120. The mixing chamber 170 may have any size, shape, or configuration.

The water source 100 may be in communication with the mixing chamber 170 via a water line 190. The water line 190 may have a water pump 200 thereon. The water pump 200 may be of conventional design. The water line 190 may have a pair of water line isolation valves 210 thereon. The detergent source 130 may be in communication with the mixing chamber 170 via a detergent line 200. The detergent line 200 may have a detergent pump 230 thereon. The detergent pump 230 may be of conventional design. The detergent line 200 may have as pair of detergent line isolation valves 240 thereon. The anti-static solution source 150 may be in communication with the mixing chamber 170 via an anti-static solution line 250. The anti-static solution line 250 may have an anti-static solution pump 260 thereon. The anti-static solution pump 260 may be of conventional design. The anti-static solution line 250 may have a pair of anti-static solution line isolation valves 270 thereon. Other components and other configurations may be used herein.

The compressor wash system 100 may include a main line 280 leaving the mixing chamber 170. A bellmouth line 290 may diverge from the main line 280 at a T-joint 295 and the like. The T-joint 295 may be of conventional design. The bellmouth line 280 may lead to a bellmouth manifold 300. The bellmouth manifold 300 may be positioned about the bellmouth 75 of the compressor 15. The bellmouth manifold 300 may have a number of bellmouth nozzles 310 in communication therewith. A bellmouth line stop valve 320 may be positioned thereon. Other components and other configurations may be used herein.

The compressor wash system 100 also may include an X-stage line 330 and a Y-stage line 340. In this example, the X-stage may be the ninth stage of the compressor 15 and the Y-stage 340 may be the thirteenth stage of the compressor 15 although any stage may be used herein. The X-stage line 330 and the Y-stage line 340 may extend from the main line 280 at a three-way valve 350 and the like. The three-way valve 350 may be of conventional design. The X-stage line 330 may be in communication with the X-stage extraction pipe 92 via an X-stage quick disconnection valve 360. The Y-stage line 340 may be in communication with the Y-stage extraction pipe 94 via a Y-stage quick disconnect valve 370. The quick disconnect valves 360, 370 may be of conventional design. Other components and other configurations may be used herein.

The compressor wash system 100 may be operated by a wash controller 380. The wash controller 380 may provide the water 120, the detergent 140, and the anti-static solution 160 to the mixing chamber 170 and to the compressor 15 in the appropriate ratios thereof. The wash controller 380 may be any type of programmable logic device and may be in communication with the overall control system of the gas turbine engine 10. Specifically, the wash controller 380 may control valve interlocks, fluid levels, pump operation, connectivity signals, flow sensors, operation of the three-way valve, temperature, pressure, timing, and the like. Various types of sensors may be used herein to provide feedback to the wash controller 380. Access to the wash controller 380 and the operation parameters herein may be restricted to ensure adequate cleaning and coverage.

In use, the wash skid 165 with the fluid sources 110, 130, 150 may be positioned about the gas turbine engine 10. Alternatively, the fluid sources 110, 130, 150 may be more permanently located nearby in whole or in part. The X-stage line 330 may be connected to the X-stage extraction pipe 92 via the X-stage quick disconnect valve 360 and the Y-stage line 340 may be attached to the Y-stage extraction pipe 94 via the Y-stage quick disconnect valve 370. Other stages 55 of the compressor 15 also may be used.

The wash controller 380 may determine the appropriate ratio of water 120 and the detergent 340 and activate the water pump 200 and the detergent pump 230 so as to pump the appropriate volumes of water 120 and the detergent 140 to the mixing chamber 170. A first portion of the detergent/water mixture 390 may flow to the bellmouth manifold 300 for injection into the bellmouth 75 of the compressor. A second portion of the detergent/water mixture 390 also may flow to the X-stage line 330 and/or the Y-stage line 340 via the three-way valve 350. The wash controller 380 then may turn the pumps 200, 230 off once the predetermined volume of the detergent/water mixture 390 has been injected into the compressor 15. The wash controller 380 may again activate the water pump 200 to provide a water rinse if requested. The volume of the water 120 in the rinse may vary.

The wash controller 380 then may activate the water pump 200 and the anti-static solution pump 260 to pump a volume of water 120 and a volume of the anti-static solution 160 to the mixing chamber 170. A first portion of an anti-static solution/water mixture 400 may flow to the bellmouth manifold 300. A second portion of the anti-static solution/water mixture 400 also may flow to the X-stage line 330 and/or the Y-stage line 340. The wash controller 380 may turn the pumps 200, 260 off once an appropriated volume of the anti-static solution/water mixture has been injected therein. The compressor 15 may be rotated after the application of the antistatic solution/water mixture 400 at a predetermined speed and for a predetermined time to ensure adequate solution coverage and adherence to the blades 60 and the vanes 67. After draining, the compressor may be rotated with the appropriate bleed valves open so as to facilitate drying of the anti-static coating. Other method steps also may be used herein in any order.

The compressor wash system 100 thus provides improved cleaning and application of the anti-static solution 160 throughout the compressor 15 including through the later stages. The increased coverage of the anti-static solution 160 may enhance the ability to suppress the electrostatic attraction of material on the compressor blades 60 as well as the stationary vanes 67 with a reduced propensity to form such deposits. Better anti-static coverage may provide water wash recovered gains for a longer period of time. The overall gas turbine engine 10 thus may have improved sustainable performance characteristics. Moreover, the compressor wash system 100 uses the existing extraction piping of the compressor 15 such that it is easy to maneuver and is easy to use.

The compressor wash system 100 also may provide the ability to control the injection rate and quantity of the anti-static solution 150 to ensure adequate coverage on all of the stages 55 of the compressor 15. The wash controller 380 also may ensure that the compressor stages are at the appropriate temperature, may provide for the appropriate ratios of the detergent/water mixture 390 as well as the anti-static solution/water mixture 400, and may provide for the appropriate cycle times. Moreover, the wash controller 380 may vary the ratio and volume of the detergent/water mixture 390 and/or the anti-static solution/water mixture 400 that may be delivered to the bellmouth 75, the X-stage extraction pipe 92, and/or the Y-stage extraction pipe 94. Other stages and other types of fluids may be used herein with other types of control systems.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A system comprising:

a turbine;

a compressor comprising a bellmouth, wherein the compressor comprises an air extraction system comprising one or more extraction pipes in communication with and extending between one or more extraction ports in the compressor and one or more stages of the turbine; and a wash system configured to be attached to and in fluid communication with the air extraction system, the wash system comprising:

a water source comprising water;

a first fluid source comprising a first fluid;

a mixing chamber in communication with the water source and the first fluid source;

a water pump configured to pump the water to the mixing chamber;

a first fluid pump configured to pump the first fluid to the mixing chamber;

a bellmouth line in communication with the mixing chamber and the bellmouth; and a first fluid line configured to be in fluid communication with the mixing chamber and the one or more extraction pipes such that a fluid from the mixing chamber comprising the water, the first fluid, or a mixture thereof is injected into the compressor via the one or more extraction ports, wherein the air extraction system comprises a first configuration in which a portion of a flow of air in the compressor is extracted therefrom for use in cooling the turbine, and wherein the air extraction system comprises a second configuration in which the water, the first fluid, or the mixture thereof is injected into the compressor via the one or more extraction ports when the wash system is attached to the air extraction system.

2. The system of claim 1, wherein the first fluid source comprises a detergent source, and wherein the first fluid comprises a detergent.

3. The system of claim 1, wherein the first fluid source comprises an anti-static solution source, and wherein the first fluid comprises an anti-static solution.

4. The system of claim 1, wherein the mixing chamber comprises one or more angled counter flow nozzles therein, the one or more angled counter flow nozzles extending into the mixing chamber at an angle with respect to a central axis of the mixing chamber and configured to inject the first fluid at the angle in a direction counter to a flow of the water in the mixing chamber.

5. The system of claim 1, wherein the water source is in communication with the mixing chamber via a water source line and the water pump.

6. The system of claim 1, wherein the first fluid source is in communication with the mixing chamber via a first fluid source line and the first fluid pump.

7. The system of claim 1, wherein the bellmouth line is in communication with a plurality of bellmouth nozzles positioned about the bellmouth.

8. The system of claim 1, wherein the first fluid line comprises a quick disconnect valve in communication with the one or more extraction pipes.

* * * * *